US005349727A

United States Patent [19]

Niebergall

[11] Patent Number: 5,349,727

[45] Date of Patent: Sep. 27, 1994

[54] STORAGE CONTAINER FOR CREMATION ASHES

[76] Inventor: Glenn Niebergall, 1324 Hamilton Street, Regina, Saskatchewan, Canada, S4R 2B5

[21] Appl. No.: 51,246

[22] Filed: Apr. 23, 1993

[51] Int. Cl.[5] ..... A61G 17/00

[52] U.S. Cl. ..... 27/1; 27/7; 27/19; 220/528

[58] Field of Search ..... 27/1, 35, 19, 7; 220/528, 408, 410

[56] References Cited

U.S. PATENT DOCUMENTS

| | | | |
|---|---|---|---|
| 2,009,724 | 7/1935 | Bircher | 27/1 |
| 3,167,844 | 2/1965 | Bachofner | 27/1 |
| 3,488,818 | 1/1970 | Orr | 27/19 |
| 3,966,075 | 6/1976 | Schultz | 220/408 |
| 4,199,848 | 4/1980 | Kohnert | 27/1 |

*Primary Examiner*—Carl D. Friedman
*Assistant Examiner*—Kien Nguyen
*Attorney, Agent, or Firm*—Adrian D. Battison; Stanley G. Ade; Murray E. Thrift

[57] ABSTRACT

A storage container for cremation ashes comprises an outer decorative container with a hollow interior of generally rectangular shape. A similar rectangular inner container is formed of a transparent plastics material with a sealable end cap so that the ashes can be inserted and contained within the hollow inner container and displayed through the transparent material of the inner container. This presents the ashes in a hygienic appearance without danger of spillage.

6 Claims, 1 Drawing Sheet

STORAGE CONTAINER FOR CREMATION ASHES

BACKGROUND OF THE INVENTION

This invention relates to a storage container for cremation ashes.

As a technique for disposal of the dead body, cremation is becoming more popular for various reasons. Cremation generates ashes which are of course of greatly reduced volume relative to the volume of the original body. The ashes are wholly hygienic and have little bodily material but it remains a problem as to how to dispose of the ashes. In some cases ashes are spread at a particularly preferred location of the deceased. In some cases the ashes are interred in an urn so as to provide a burial plot which can act as a memorial although the burial plot is of course significantly reduced in dimension relative to the conventional burial plot for the interred body.

In other cases the ashes are stored in an urn or other container which can be displayed as a memorial or ornament in the home of a relative or which can be simply stored away. Little attention has been given to the development of containers or urns suitable for this purpose and in many cases the container is simply an open container into which the ashes are poured and from which the ashed can be spilled if the container is tipped or upset.

It is one object of the present invention, therefore, to provide an improved storage container for cremation ashes.

SUMMARY OF THE INVENTION

According to the invention, therefore, there is provided a storage container for cremation ashes comprising an outer decorative container formed of an opaque material, defining a hollow interior, and including an openable lid allowing access to hollow interior, and a separate inner container mounted in the hollow interior and removable therefrom through the lid, the inner container being formed of a rigid plastics material and having a sealable cap for containing the cremation ashes within the outer container. Preferably the inner container is transparent for viewing of the ashes.

One embodiment of the invention will now be described in the conjunction with the accompanying drawing in which

DETAILED DESCRIPTION

Figure 1:
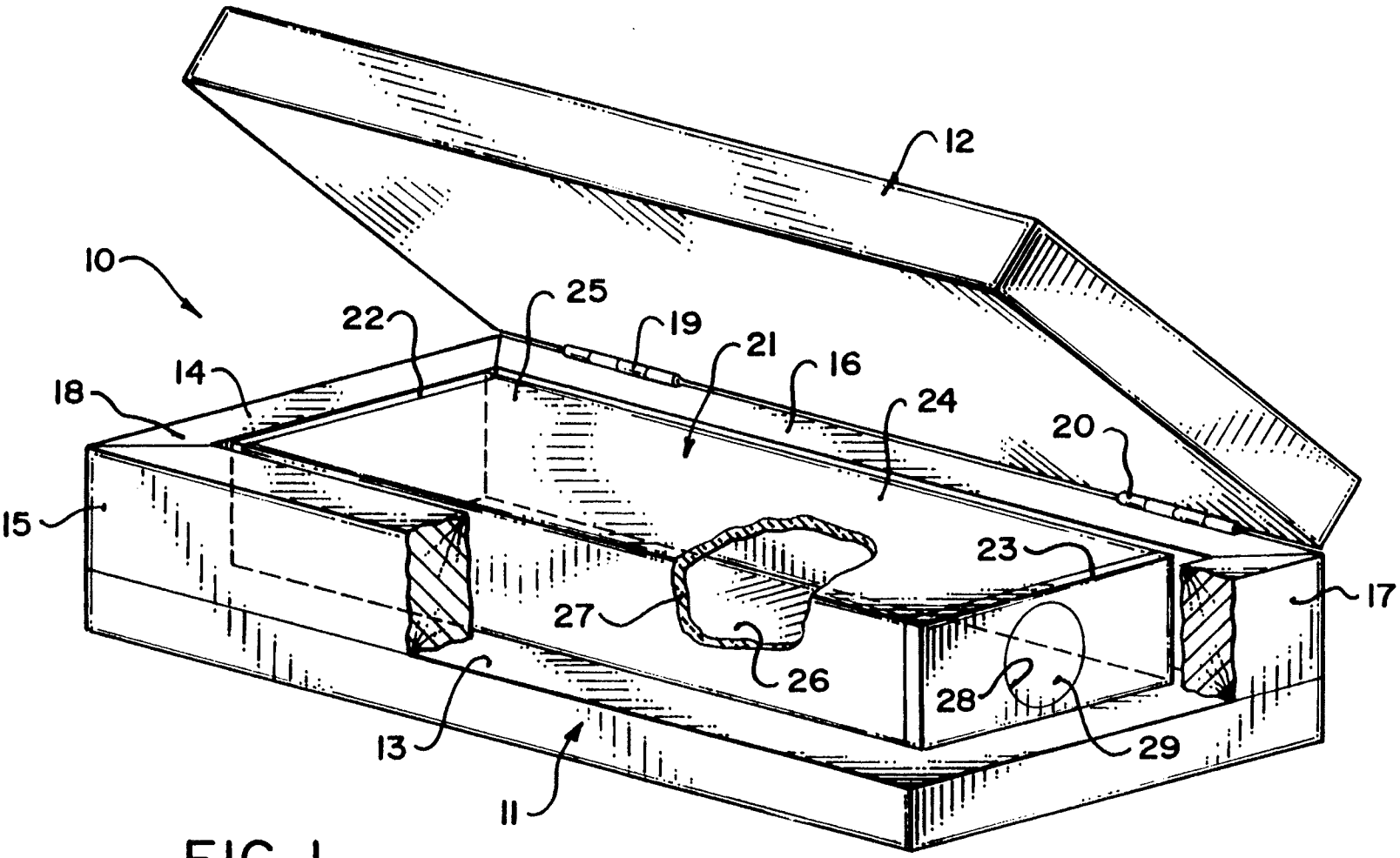
FIG. 1 is an isometric view partly broken away of a container according to the present invention.

The container of the present invention comprises an outer container 10 including a base or receptacle portion 11 and a lid 12. The base or receptacle portion 11 includes a horizontal bottom wall 13 and four upstanding walls 14, 15, 16 and 17, the walls 15 and 17 being shown broken away to expose the interior of the receptacle portion 11. The side walls terminate at a common horizontal top plane 18 on which is hinged the lid 12 by hinges 19 and 20. The lid is hinged along the rear edge so that they can be opened to expose the upper surface 18 and the hollow interior defined by the vertical walls. The lid can also be closed down onto the horizontal surface 18 to fully enclose the hollow interior. Although not shown, the base portion and the lid can include various decorative elements including moldings, brass fittings, name plates and the like which provide a decorative appearance to the outer exterior of the container when closed to provide an attractive appearance when used as a memorial or ornament exposed to view.

The container further includes an inner container 21 in the form of a hollow rectangular box formed of a rigid transparent plastics material such as acrylic. The box is formed from two end plates 22 and 23 which are welded or bonded to a sleeve portion 24 of rectangular cross section. The sleeve portion thus defines a top surface 25 and a bottom surface 26 which are flat and rectangular. The dimensions of the box are such that the top surface 25 and the bottom surface 26 form the largest areas so that the depth of the box is significantly less than the width of the box transverse to the hinge line or the length of the box longitudinal of the hinge line. The wall forming the plastics material of the sleeve is indicated at 27 and this is sufficiently thick to provide a rigid structure but is formed of a transparent plastics material to allow the viewing through the container of the material on the inside.

In some cases the inner container may be formed of an opaque plastics material if it is not required to view the contents.

One of the end caps 22 and 23 includes an opening 28 through which the ashes can be inserted by careful pouring through a funnel. The opening 28 is circular and is closed by an end cap 29 which is similarly circular and can be bonded or welded into place once the ashes are inserted and the end cap located.

The shape of the inner container is arranged so that it is substantially exactly matches the hollow interior of the outer container that it has a height substantially equal to that of the upstanding walls and a top and bottom surface substantially equal to the area of the base. When the lid is opened therefore, the viewer is presented with an attractive appearance provided by the top acrylic sheet of the box which is clean, neat and of hygienic appearance with the ashes wholly contained within the interior of the inner container. There is no possibility therefore of spillage even if the outer container should be wholly upset. The inner container can be removed from the outer container and placed separately of the outer container should it be desired to display a second inner container within the outer container. Or for burial of just the inside box and the outer container used for burial of other loved ones or the outer container to be kept with the loved one momentos.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A storage container for cremation ashes comprising an outer decorative container, formed of an opaque material, comprising a base wall for resting on a support surface and upstanding walls defining a hollow interior, and including an openable lid allowing access to the hollow interior; and an inner container mounted in the hollow interior of the outer container, the inner container being separate from the outer container and removable therefrom through the lid, the inner container being formed of a rigid plastics material and having a base for resting adjacent the base wall of the outer container and cover walls defining with the base a hollow interior of the inner container, one of the base and the cover walls having an opening therein which is closed by a sealed cap so that the base, the cover walls and the sealed cap form a fully closed, sealed enclosure surrounding the hollow interior, and cremation ashes contained within the hollow interior of the inner container, the base and cover walls of the inner container being mechanically connected such that removal of the cover walls through the lid necessarily carries the base therewith.

2. The storage container according to claim 1 wherein outside dimensions of the inner container match substantially the interior dimensions of the hollow interior.

3. The storage container according to claim 2 wherein the inner container is substantially rectangular having four side walls upstanding from the base and a top coextensive with the base.

4. The storage container according to claim 3 wherein the top walls and base are each of greater area than the side walls.

5. The storage container according to claim 4 wherein the opening is provided in the side wall.

6. A storage container for cremation ashes comprising an outer decorative, generally rectangular container formed of an opaque material and having a base and four upstanding walls defining a hollow interior, and including an openable lid covering and allowing access to the hollow interior, and a separate, generally rectangular inner container mounted in the hollow interior and removable therefrom through the lid, the inner container being formed of a rigid transparent plastics material and having a lower wall generally coextensive with the base, four upstanding side walls and an upper wall generally coextensive with the lower wall, each of the walls being permanently interconnected to adjacent walls at edges thereof to define an integral container, an opening in one upstanding side wall for poured insertion of cremation ashes and a sealable cap for closing the opening.

* * * * *